US006601510B1

(12) United States Patent
Michalik et al.

(10) Patent No.: US 6,601,510 B1
(45) Date of Patent: Aug. 5, 2003

(54) DEVICES FOR CLEANING A ROLLER

(75) Inventors: Horst Bernhard Michalik, Höchberg (DE); Manfred Wolfgang Hartmann, Elfershausen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/868,634

(22) PCT Filed: Dec. 24, 1999

(86) PCT No.: PCT/DE99/04094

§ 371 (c)(1),
(2), (4) Date: Jun. 27, 2001

(87) PCT Pub. No.: WO00/40417

PCT Pub. Date: Jul. 13, 2000

(30) Foreign Application Priority Data

Dec. 31, 1998 (DE) ..... 198 60 855

(51) Int. Cl.[7] ..... B41L 41/00
(52) U.S. Cl. ..... 101/425; 101/424
(58) Field of Search ..... 101/424, 425, 101/423; 15/256.5, 256.51, 256.52, 256.53; 134/151, 159

(56) References Cited

U.S. PATENT DOCUMENTS

| | | | | |
|---|---|---|---|---|
| 458,349 A | * | 8/1891 | Greene | 285/24 |
| 3,983,813 A | | 10/1976 | Tani | 101/425 |
| 5,148,746 A | | 9/1992 | Fuller et al. | 101/142 |
| 5,463,951 A | * | 11/1995 | Waizmann et al. | 101/147 |
| 5,769,461 A | | 6/1998 | Hildebrandt et al. | 285/29 |
| 5,816,163 A | * | 10/1998 | Achelpohl et al. | 101/424 |
| 5,860,361 A | * | 1/1999 | Nanjyo et al. | 101/424 |

FOREIGN PATENT DOCUMENTS

| | | |
|---|---|---|
| DE | 25 22 743 | 1/1976 |
| DE | 196 09 737 | 5/1997 |
| EP | 0 591 634 | 4/1994 |
| EP | 0 693 378 | 1/1996 |

* cited by examiner

*Primary Examiner*—Andrew H. Hirshfeld
*Assistant Examiner*—Anthony H. Nguyen
(74) *Attorney, Agent, or Firm*—Jones Tullar & Cooper, PC

(57) ABSTRACT

A roller or a cylinder of a rotary printing press is cleaned using a liquid. A carriage is movable back and forth along the roller or cylinder. A supply container carries a clean liquid in a specified amount. A dirty liquid is returned to a receptacle. The clean and dirty liquids are supplied to, and removed from, the carriage when it is in a parked position.

15 Claims, 1 Drawing Sheet

DEVICES FOR CLEANING A ROLLER

FIELD OF THE INVENTION

The present invention relates to devices for cleaning a roller by using a cleaning fluid. The fluid is located in a reservoir which can be displaced in the axial direction of the roller. A catch basin for the fluid may also be provided.

DESCRIPTION OF THE PRIOR ART

A washing device for printing press cylinders is known from EP 0 591 634 A1. After having been serviced, a so-called washing crosspiece is brought into a position close to the cylinder and is automatically coupled there with supply lines.

U.S. Pat. No. 5,148,746 A describes an axially displaceable device for cleaning a printing plate.

An apparatus for cleaning rollers is known from EP 0 693 378 B1. A bristle brush is guided along the roller to be cleaned, and cleaning fluid is simultaneously introduced into the inlet gap of both rollers. The apparatus contains a reservoir for cleaning fluid and a catch basin for dirt particles to be removed.

DE 25 22 7453 A discloses a device for cleaning a cylinder. A reservoir for cleaning fluid and a catch basin can be displaced along the cylinder. A supply station, which is fixed to the frame, is provided for filling the reservoir.

SUMMARY OF THE INVENTION

The object of the present invention is directed to providing devices for cleaning a roller.

In accordance with the present invention, this object is attained by using a cleaning fluid that is carried in a reservoir. The reservoir can be moved in the axial direction of the roller. The reservoir can be connected with a stationary supply unit when it is in its parked position. A catch basin for used cleaning fluid may also be provided.

The advantages to be obtained by the present invention reside, in particular, in that dirty cleaning fluid can be automatically removed from a cleaning device which, in the operational state, can be displaced axis-parallel and which, in its parked position, lies outside of the paper web width, and can be filled with fresh cleaning fluid or with a liquid stripping agent.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 2:
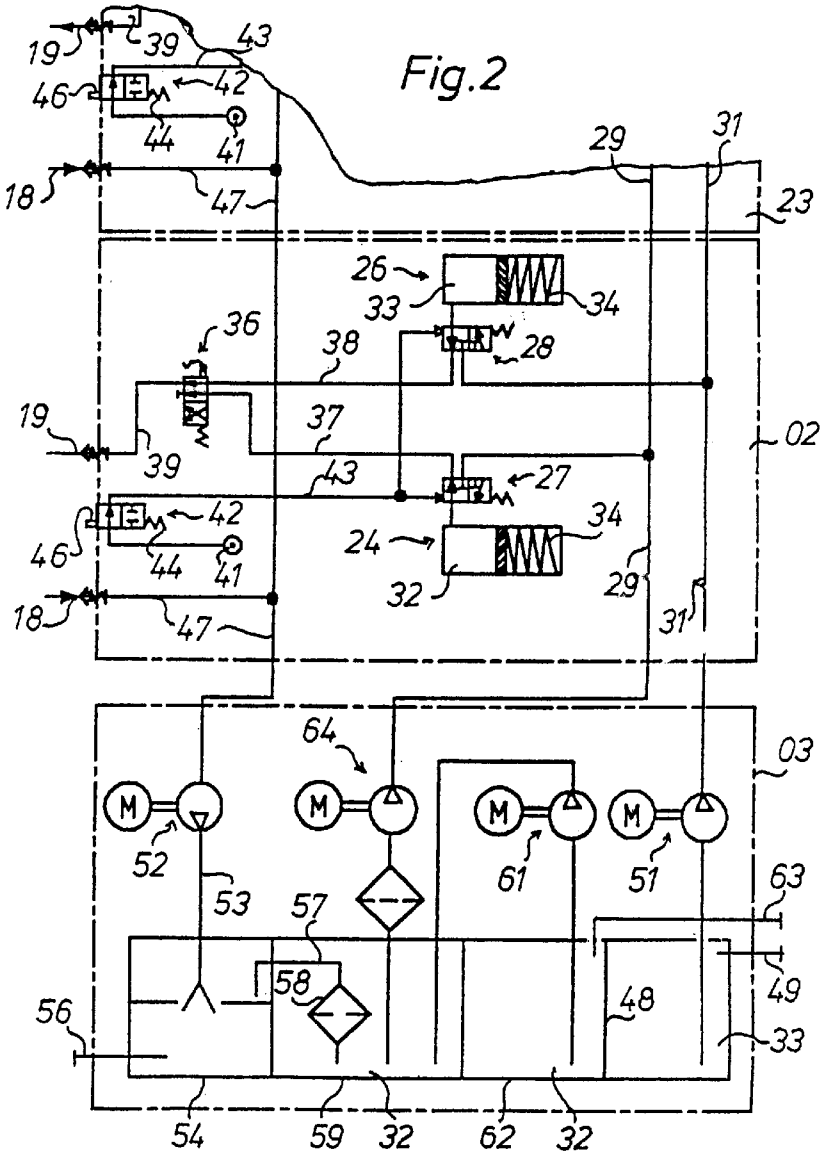
Figure 1:
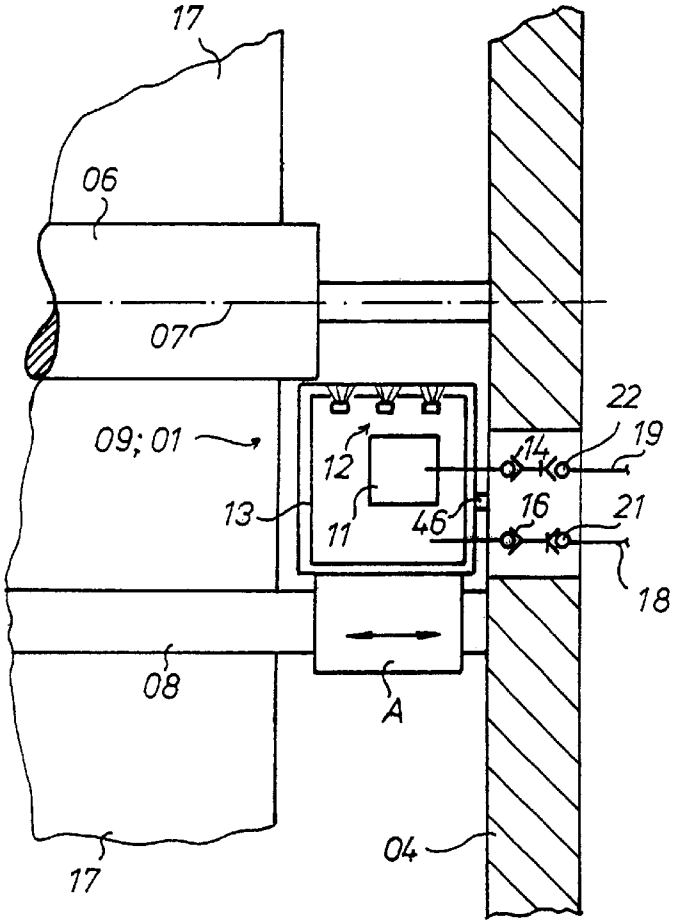
FIG. 1, a partial schematic view from above of a paper guide roller with a cleaning device arranged in front of it in a parked position, and which can be displaced in an axis-parallel direction, FIG. 2, a basic fluid circuit diagram of the stationary portion of the supply arrangements for the displaceable cleaning device in accordance with FIG. 1.

An arrangement for supplying a cleaning device for rollers, cylinders or the like with fluid, for example in a rotary printing press, consists of a cleaning device 01 located in the immediate vicinity of a roller, as well as of an associated stationary supply unit 02, which is connected with a central station 03, also arranged to be stationary all as seen in FIGS. 1 and 2.

The displaceable cleaning device 01 is arranged in the immediate vicinity of a roller, for example a paper guide roller 06, which is seated between lateral frames, only one lateral frame 04 being represented in FIG. 1. The cleaning device 01 consists of a cross arm-like carriage guidance 08, extending axis-parallel with the axis of rotation 07 of the paper guide roller 06. The carriage guidance 08 is fixed in place in the lateral frame, and receives a carriage 09, which can be moved back-and-forth in the above-mentioned axis-parallel direction A. The carriage 09 is displaced, for example by a linear drive, which is generally conventional and thus is not specifically represented, and supports at least one reservoir 11 for fluid and one or more spray nozzles 12 that are aimed in the direction of the paper guide roller 06. The reservoir 11 is connected with the spray nozzles 12 via pipelines and a pump unit, not specifically represented.

The carriage 09 further includes a catch basin 13 for used fluid, which also contains cleaning residue. The catch basin 13, as well as the reservoir 11, are each connected via a pipeline with a respective check valve 14, 16, which check valves 14, 16 are arranged on a portion of the carriage housing near the lateral frame and can be unblocked. The carriage 09 furthermore can have rotatable brush arrangements, also not specifically represented. The carriage 09 can be displaced during production, i.e. while a paper web 17 is being guided, or also without the presence of a paper web 17, from a first parked position that is represented in FIG. 1, on the right next to the paper web 17, into a second parked position, that is not represented, located on the left on the other side of the paper web width next to the paper web 17. This is accomplished, for example, by means of a belt drive, not specifically represented, fixed in place on the carriage, and an associated electric motor. The carriage 09 is stopped in the respective right or left parked position by use of suitable limit sensors.

The lateral frame 04 includes two connecting lines 18, 19, which have two check valves 21, 22, which can be unblocked, on the side facing the carriage 09. In the case of a first parked position, the check valve 16 located on the carriage 09 constitutes, together with the check valve 21 fixed in place on the lateral frame, a self-locking line connection for the connecting line 18. The same applies for the cooperation between the check valves 14 and 22, which can be unblocked, for a connecting line 19, as shown in FIG. 1.

The reservoir 11 of the carriage 09 is also not connected with the stationary supply unit 02 or 23 during the cleaning operation.

The supply unit 02 can be arranged in the immediate vicinity of a parked position of the carriage 09 or, together with a further supply unit 23 assigned to another roller, can be stationary arranged in a central position.

Each supply unit 02, 23, as seen in FIG. 2, has a metering cylinder 24 for cleaning fluid 32, and a metering cylinder 26 for a liquid stripping agent 33. A metering valve 27, 28 is placed upstream of each metering cylinder 24, 26, through which the metering cylinder 24, 26 receives cleaning fluid 32, or stripping agent 33, from a pressure line 29, 31. The filling pressure of the liquid 32, 33 is greater than that of a compression spring 34 arranged in the metering cylinder 24, 26 and acting on the piston bottom, so that the filling amount of each metering cylinder 24, 26 can be set.

It is possible to selectively remove cleaning fluid 32 out of a first line 37 from the metering cylinder 24, or liquid stripping agent 33 out of a second line 38 from the metering cylinder 26 by operation of an electrically operable reversing switch 36, and to supply it via the line 39 to the connecting line 19, as shown in FIG. 1. In addition to the actuation of the check valve 14, 22, or 16, 21, for example by moving the carriage 09 into the right parked position, the metering valve 27, or 28, must also be opened. This is accomplished by use of a pneumatic pulse, which is passed on from a compressed air connector 41 via a pneumatically actuable limit switch 42, as well as via a compressed air line 43, to the metering valves 27, 28. The limit switch 42 has a switching cam 46, which can be actuated against the force of a spring 44 and which can be actuated, for example, by the carriage 09 moving into the parked position.

The check valve 21 is connected via a connecting line 18 with a suction or vacuum line 47, as may be seen in FIG. 2.

All depicted supply units 02, 23, as well as other possible supply units, that are not specifically depicted, are connected with the compressed air connector 41, as well as with a suction line 47 for used cleaning fluid, as well as cleaning residue contained in the used cleaning fluid, and respectively a pressure line 31 for stripping agent 33.

All of the individual supply units 02, 23 are connected with the central station 03 via the lines 29, 31, 47. The central station 03, together with the supply units 02, 23, can also be arranged in a central location. Central Station 03 contains a reservoir 48 for liquid stripping agent 33, which is supplied via a fresh agent connector 49 and is conducted to the pressure line 31 via a charge pump unit 51.

A vacuum is generated in the vacuum or suction line 47 by a removal pump unit 52, so that the used liquid, also containing cleaning residue, is conducted via a return line 53 to a return tank 54. Mud or a grainy residue are pumped out of the return tank 54 via a removal connector 56. Filtered cleaning fluid 32 reaches a mixing tank 59 through an overflow line 57 and a filter 58 arranged inbetween. The mixing tank 59 receives cleaning fluid 32 from a storage tank 62 via a mixing pump unit 61, which cleaning fluid 32 is supplied to the storage tank 62 via a damping agent connector 63. A charge pump unit 64 pushes the cleaning fluid 32 into the pressure line 29.

The arrangement for supplying a cleaning device with cleaning fluid in accordance with the present invention operates as follows: the carriage 09 takes up cleaning or stripping fluid in the first or right parked position depicted in FIG. 1. In the course of this action, the metering cylinder 24, 26 can receive up to 120% of the filling volume of the reservoir 11 located on the carriage 09, depending on the filling pressure acting against the compression spring 34. The result of this is that the excess liquid delivered to the reservoir 11 from the metering cylinders 24, 26 runs directly from the reservoir 11 into the catch basin 13 and a sump, which is formed in the catch basin 13 from ink residue and the like, remains capable of being aspirated off.

The liquid received in the reservoir 11 is sufficient for completely spraying the paper guide roller 06 with cleaning fluid 32 or with stripping agent 33 during the passage of the carriage 09 in the axis parallel direction A along the guide roller 06 and into the left parked position. Used up cleaning fluid, i.e. cleaning fluid containing fiber and ink particles, is caught in the catch basin 13 and is aspirated off through the lines 18, 47 during the next stop of the carriage 09 in the right parked position. This used cleaning fluid is conducted to the central station 03 for being reconstituted.

in this way, paper guide rollers 06, or the like, can be sprayed with preselectable liquid in preselectable amounts during, prior to, or after production.

while a preferred embodiment for devices for cleaning a roller in accordance with the present invention has been set forth fully and completely hereinabove, it will be apparent to one of skill in the art that a number of changes in, for example the particular kind of cleaning fluid use, the type of printing press used to print the paper web, and the like could be made without departing from the true spirit and scope of the present invention which is accordingly to be limited only by the following claims.

What is claimed is:

1. A device for cleaning a roller comprising:

a cleaning fluid;

a movable reservoir for said cleaning fluid, said movable reservoir being displaceable along an axial direction of the roller between a parked position adjacent a lateral frame and a cleaning position adjacent the roller to be cleaned;

a supply unit for said cleaning fluid, said supply unit being stationary and remote from said movable reservoir;

cleaning fluid lines on said reservoir, said cleaning fluid lines connecting said reservoir and said stationary supply unit only in response to movement of said reservoir to said parked position; and closing means for said cleaning fluid lines on said reservoir and counter elements on said lateral frame for engaging said closing means for said cleaning fluid lines when said reservoir is moved to said parked position.

2. The device of claim 1, further including a displaceable carriage and wherein said reservoir is arranged on said displaceable carriage.

3. The device of claim 1 further including a catch basin displaceable in said axial direction of the roller.

4. The device of claim 2 wherein said displaceable carriage has a carriage wall and further where said closing means are on said carriage wall.

5. The device of claim 3 further including a displaceable carriage having a carriage wall and wherein said catch basin is arranged on said displaceable carriage, and further wherein said catch basin has a drain line, said drain line engaging a line when said reservoir is in said parked position, and further including a closing means for said drain line, said drain line being located on said carriage wall.

6. The device of claim 1 further including a stationary central unit, said stationary central unit supplying fresh cleaning fluid to said movable reservoir and receiving used cleaning fluid from said movable reservoir.

7. The device of claim 1 further including a plurality of rollers, each said roller having a separate stationary supply unit.

8. The device of claim 6 wherein said central unit is connected to said movable reservoir through said cleaning fluid lines.

9. The device of claim 7 wherein all of said separate stationary supply units are connected to said central unit.

10. The device of claim 6 wherein said supply unit includes at least one replenishable metering cylinder.

11. The device of claim 10 wherein said metering cylinder has a variable volume.

12. The device of claim 6 wherein said stationary central unit includes a return tank for used cleaning fluid, a reservoir for fresh cleaning fluid, a mixing tank, a reservoir for a stripping fluid and pump units for pressure and vacuum lines.

13. The device of claim 7 a further including a stationary central unit and wherein each of said separate stationary supply units are arranged with said central unit.

14. The device of claim 1 wherein said roller is a guide roller.

15. The device of claim 1 wherein said device is arranged in a rotary printing press.

* * * * *